United States Patent [19]

Fort et al.

[11] Patent Number: 4,541,477

[45] Date of Patent: Sep. 17, 1985

[54] SOCKET CORE HANDLING AND POSITIONING DEVICE FOR A CENTRIFUGAL PIPE CASTING MACHINE

[75] Inventors: Pierre Fort, Nancy; Michel Pierrel, Pont a Mousson, both of France

[73] Assignee: Pont-a-Mousson S.A., Nancy, France

[21] Appl. No.: 610,736

[22] Filed: May 16, 1984

[30] Foreign Application Priority Data

May 27, 1983 [FR] France ..... 83 08855

[51] Int. Cl.[4] ..... B22D 13/02; B22D 13/10

[52] U.S. Cl. ..... 164/302; 164/298; 164/340

[58] Field of Search ..... 164/302, 298, 286, 340, 164/339, 137, 114; 425/425, 435

[56] References Cited

U.S. PATENT DOCUMENTS 3,074,130 1/1963 Wittmoser et al. ..... 164/302 X 4,074,748 2/1978 Négre ..... 164/302 X

FOREIGN PATENT DOCUMENTS 2024062A 1/1980 United Kingdom ..... 164/298

*Primary Examiner*—Nicholas P. Godici

*Assistant Examiner*—K. Berg

*Attorney, Agent, or Firm*—Sughrue, Mion, Zinn, Macpeak and Seas

[57] ABSTRACT

A support stirrup 7 is rotatably mounted by horizontal shaft 8 at one end of a machine for centrifugally casting iron pipes 41 having end sockets 42*a* in a chill-mould 1. A ring assembly 31, CL is mounted between the arms of the stirrup for rotation about an axis Z—Z perpendicular to the shaft axis, but the plane of the assembly is tilted from its rotation axis by an acute angle D via an offset arm 34. With the stirrup raised to an intermediate position and the ring assembly rotated 90° (FIGS. 3, 6) an operator can easily and safely mount a relatively heavy socket core 36 to the ring assembly, whereafter the latter is reverse rotated 90° and the stirrup lowered to position the core in the end of the mould (FIGS. 1, 4). The stirrup can be fully raised (FIG. 2) to enable pipe extraction and visual inspection during casting.

6 Claims, 6 Drawing Figures

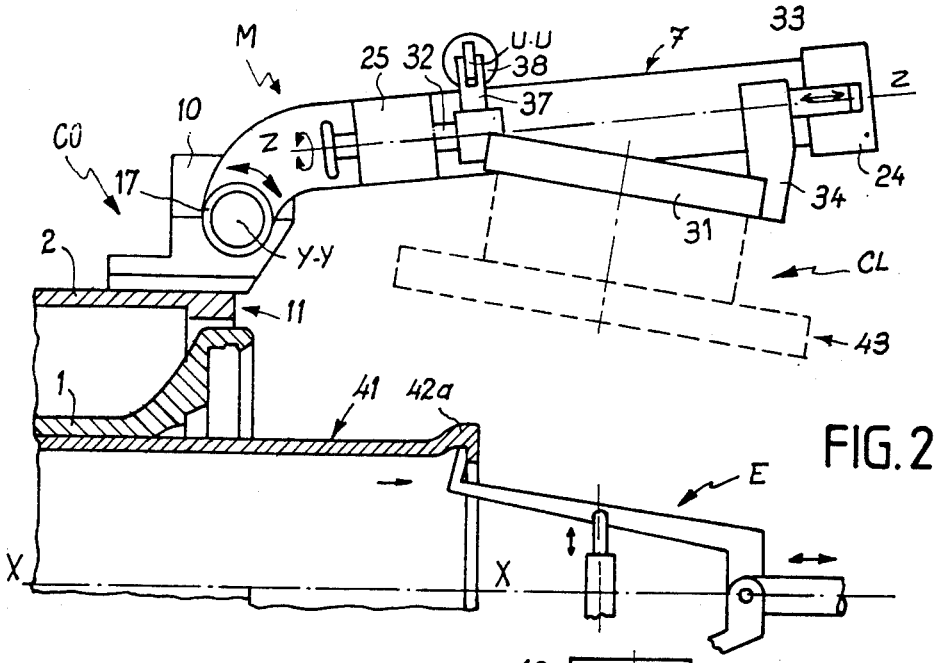
FIG. 2
FIG. 4
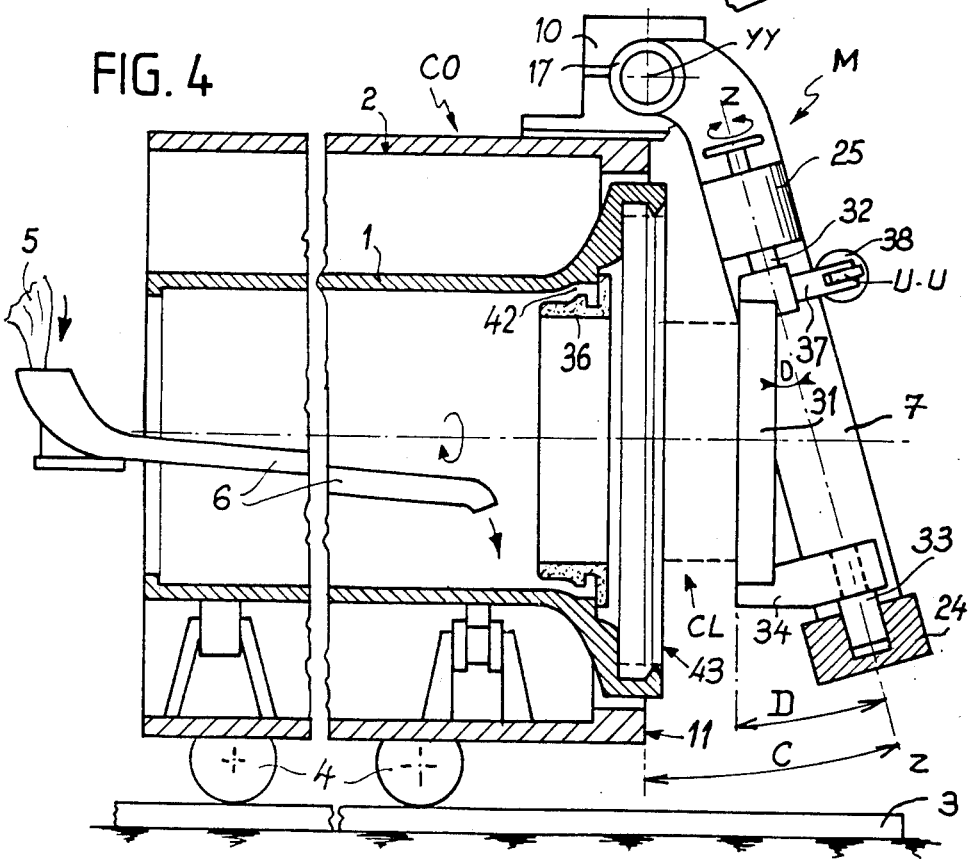

SOCKET CORE HANDLING AND POSITIONING DEVICE FOR A CENTRIFUGAL PIPE CASTING MACHINE

BACKGROUND OF THE INVENTION

This invention relates to a device for handling and positioning a socket core in a machine for the centrifugal casting of cast-iron pipes.

Such a machine of known type comprises a chill-mould mounted to rotate in a casing provided with cooling means and a gate. The gate is able to traverse the entire length of the mould interior to pour molten cast iron therein during the course of a relative translational movement between the machine casing and the gate.

The chill-mould which defines the external shape of the cast-iron pipe receives a core at one end to define the internal shape of the pipe socket. The core is made of moulding-sand, and is replaced after each casting operation. It is brought forward and positioned at the end of the mould by a handling and positioning support device to which the invention relates.

French Pat. No. 2,314,790 discloses a support device for handling and positioning a socket core at the end of a chill-mould for centrifugal casting, which is pivoted on a horizontal shaft supported by the casing of the machine and which may rotate about this shaft between an upper retracted position above the socket end of the mould and a lower position for the introduction of the core into the mould.

This support device comprises two parts, both mounted to rotate about the same horizontal shaft under the opposing actions of a jack and a counterweight: a core support proper which is retracted in an upwards direction at the time of casting and a support member which is retracted in an upwards direction in order to receive a new core but which remains in the lowered position supporting the core axially inside the chill-mould during casting.

This device requires the operator to position a new core on the support in the upwardly retracted position, and provides good visibility inside the socket of the chill-mould during casting. It is perfectly suitable for relatively light cores of small diameter (for example less than 300 mm) which an operator can easily place into position on the support in its upper position without excessive fatigue.

On the other hand, for diameters greater than 300 mm the cores become relatively heavy, which makes it arduous for an operator to repeatedly position the core on the support in its upper position a great number of times during a working shift.

SUMMARY OF THE INVENTION

It is therefore the object of the invention to provide a support device for handling and positioning cores which can be carried by an operator, making it possible to reduce their fatigue, due to a more comfortable position of the support for receiving a new core.

The device comprises a tilting support mounted on the end of the centrifugal casting machine, able to tilt about a horizontal shaft under the action of a jack supported by the machine, and having means for gripping and supporting the core in order to introduce it into the chill-mould.

According to the invention, the core gripping and supporting means are mounted to pivot on the support about an axis of rotation at right angles to the aforesaid shaft, under the action of a control jack and comprising a ring pivoted directly on the support about the orthogonal axis such that the general plane of the ring always remains inclined at an acute angle to the orthogonal pivot axis, this angle being open towards the bottom when the ring and its support are lowered, in order to present the core gripping means in an inclined plane substantially at the height of the operator's arms and laterally of the machine.

By virtue of this arrangement, not only does the operator have a comfortable position for handling the portable cores at a distance from the heat emanating from the cast pipe, but he has a safe position since he is situated at the side of the machine, outside the path of the carriage for extracting the cast pipe from the chill-mould.

BRIEF DESCRIPTION OF THE DRAWINGS

FIG. 2 is a partial diagrammatic view in side elevation of the handling and positioning device, retracted into an upper position above the machine;

FIG. 4 is a diagrammatic view in elevation of the handling device, with a partial section of the end of the centrifugal casting machine, the handling device being in its position for positioning the core in the chill-mould;

DETAILED DESCRIPTION OF THE PREFERRED EMBODIMENT

Figure 1:
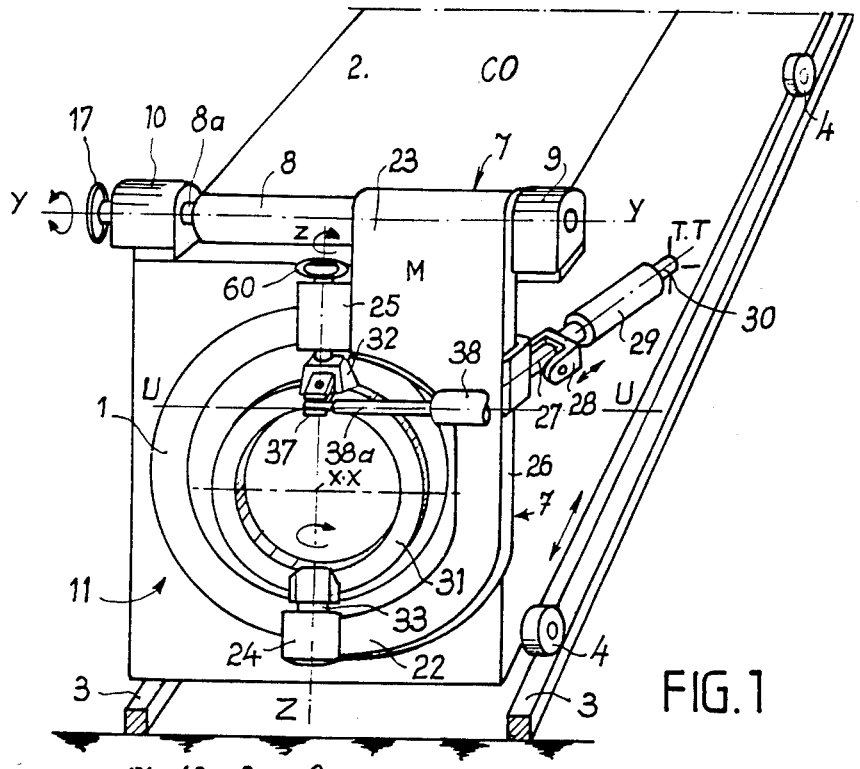
FIG. 1 is a partial diagrammatic perspective view of a centrifugal casting machine equipped with a device for handling and positioning a socket core according to the invention, in a lowered position.

The device for handling and positioning socket cores such as the core 36 illustrated in the drawings is provided at the end of a machine for the centrifugal casting of cast-iron pipes comprising a socket.

In manner known per se, the casting machine CO comprises a chill-mould 1 housed in a casing 2 and set in rotation about an axis of revolution X—X. The machine may travel on parallel rails 3 by virtue of small wheels 4, along the longitudinal axis X—X, in the direction of a flow gate 5 for supplying the molten metal to the chill-mould through a slanted pour spout 6 mounted independently of the machine CO.

The core 36, constituted by agglomerated sand (FIG. 4), is positioned in the socket end of the mould 1 before the beginning of centrifugal casting in order to define an annular volume 42 at the end of the mould which is filled with molten metal during casting to form the socket of the pipe.

The device M for handling and positioning the core 36 comprises a tilting support 7 mounted on the end of the casting machine in the form of a stirrup, and able to tilt about a horizontal shaft 8 on the axis Y—Y perpendicular to the axis X—X. The shaft may rotate at its ends in two bearings 9 and 10 rigidly fixed at the upper corners of the casing 2 and substantially opposite the side faces of the latter, so that the vertical median plane of the shaft 8 along axis Y—Y virtually coincides with the plane of the end face 11 of the casing.

In an end view of the casting machine CO, the tilting support 7 is in the shape of a U or a stirrup with short sides of substantially equal length open respectively below and above the axis X—X, the lower side 22 being narrower than the upper side 23 integral with the shaft 8. The support 7 may tilt about the latter under the action of a jack 29 mounted laterally on the machine CO. The support 7 includes means for gripping and supporting the core 36 in order to introduce it into the mould when the jack 29 tilts the support 7.

The gripping and supporting means are mounted to pivot on the support 7 about an axis of rotation Z—Z at right angles to the shaft 8, under the action of a control jack 38. These means comprise a ring 31 pivoted directly on the support 7 about the axis Z—Z, so that the general plane of the ring 31 always remains inclined by an acute angle D (FIGS. 3 and 4) to the pivot axis Z—Z, this angle D being open at the bottom when the ring 31 and its support 7 are lowered.

The ring 31 forms part of a yoke CL shown diagrammatically in FIGS. 2 to 4 and 6 and which cooperates with a pan 43 for supporting and positioning the core 36 in the chill-mould. The yoke CL and the pan 43 may be made in a known manner, for example according to French Pat. Nos. 2,051,993 or 2,053,388 and thus will not be described in more detail.

Figure 3:
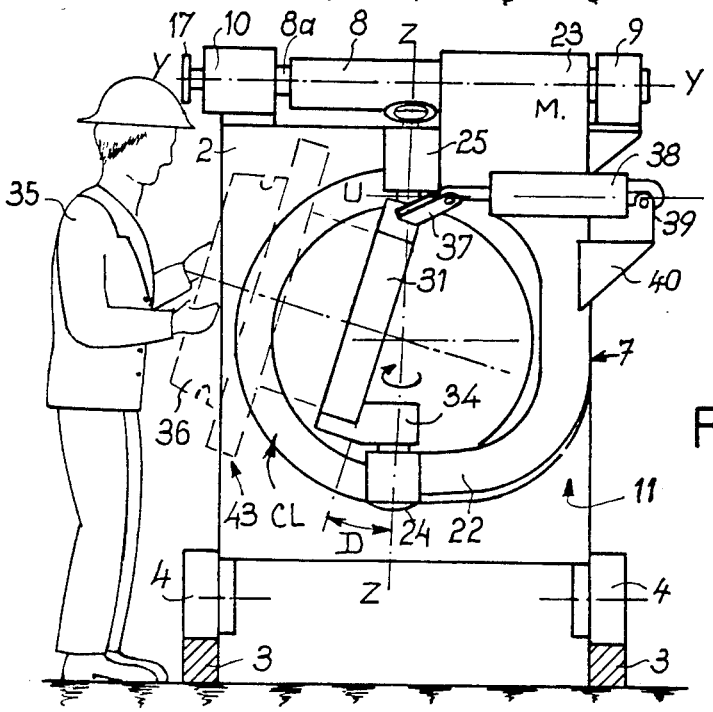
FIG. 3 is a front elevation of the handling machine in the position for the lateral loading of a core by an operator.

The ring 31 is pivoted about the axis Z—Z by journals 32, 33, whereof the journal 33 furthest from the tilting shaft 8 of the support 7, is extended by an off-set arm 34 perpendicular to the axis Z—Z. The ring 31 is fixed to the arm 34 at a point diametrically opposed to the attachment point of the journal 32 closest to the shaft 8, so that the ring 31 is inclined by the acute angle D with respect to its pivot axis Z—Z, which makes it possible to present it to the operator in the manner of a stand in order to receive a core 36 (FIG. 3).

The journals 32, 33 are respectively mounted in bearings 25 and 24 fixed to the ends of the sides 23 and 22 of the support 7, these bearings 24, 25 being coaxial with respect to the axis Z—Z.

Figure 6:
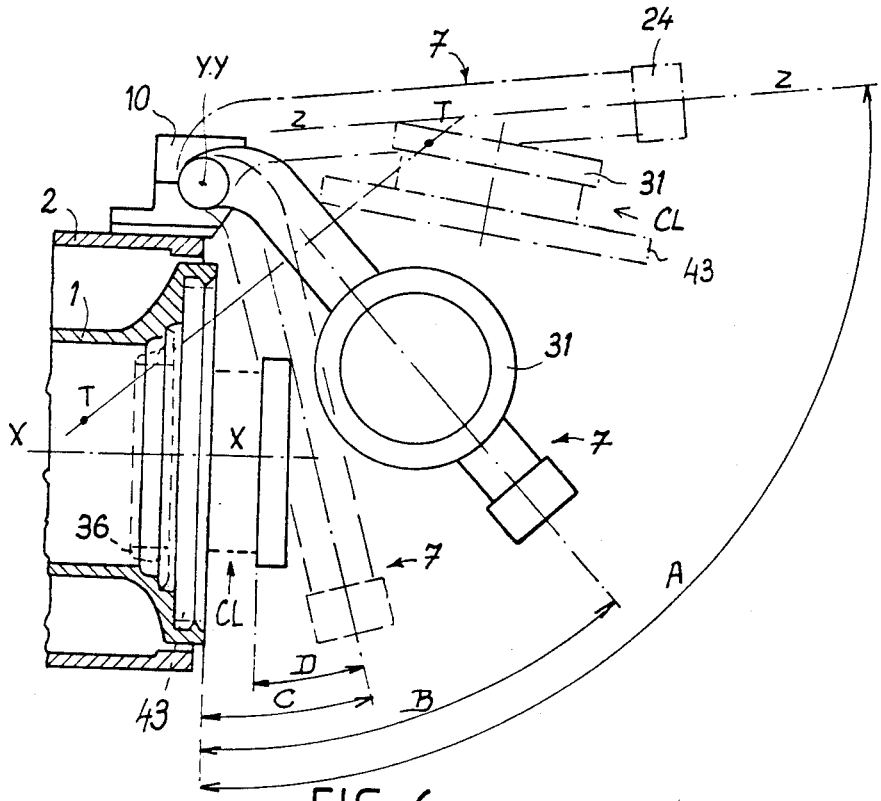
FIG. 6 is a partial diagrammatic view in lateral elevation illustrating the various angular positions which can be occupied by the tilting support of the handling device, for each of the operating stages of this device.

The support 7 is provided laterally with a head 27 (FIG. 1) on which a clevis 28 is pivoted forming the end of the rod of the jack 29, itself pivoted about a journal 30 integral with the side wall of the casing 2. The arrangement is such that the axis of translation T—T of the jack 29 is in a vertical plane, the support 7 thus being able to tilt under the action of the jack 29 about the shaft 8 in order to assume angular positions from its uppermost retraction position above the machine CO (FIG. 6, angle A) to its lowermost position for positioning the core 36 in the socket of the chill-mould (FIG. 6, angle C). Between these two extreme positions, the support 7 and the ring 31 may assume all intermediate positions as illustrated in FIG. 6, in which the support 7 forms an angle B with the plane of the end face 11 of the machine CO. The angular clearance between the extreme positions corresponding to the angles A and C is approximately 80°.

In order to retract the ring 31 laterally in order to present it to the operator 35 in the manner of a stand (FIG. 3) inclined with respect to the axis Z—Z by an angle D of approximately 15° for example, a jack 38 having a horizontal axis U—U is pivoted inside a clevis 39 integral with a bracket 40 (FIGS. 1 and 3) fixed laterally to the support 7 substantially at the same level as the connecting-rod end 27 (in FIG. 1, the bracket 40 and its clevis 39 have not been shown so as not to cover the end of the jack 29). The rod 38*a* of the jack 38 is pivoted in a clevis 37 integral with the upper part of the ring 31. The latter may thus pivot about the axis Z—Z under the action of jack 38 while still remaining inclined by the angle D to said axis.

The jack 38 follows the swinging movement of the support 7 and thus, independently of this movement, may cause the ring 31 to pivot about the axis Z—Z in a range of between 0° and more than 90°. The position of the ring 31 at 0° is illustrated in FIGS. 1, 2, 4 and 6, whereas the angular spacing of 90° with respect to the general plane of the support 7 is shown in FIG. 3 when the ring 31 is presented in a suitable manner to the operator.

According to one feature, the invention provides that the bearing 25, which is closest to the shaft 8, forms a nut for receiving an adjusting screw comprising an operating hand-wheel 60. This screw makes it possible to adjust the position of the ring 31 along the axis Z—Z in translation.

Figure 5:
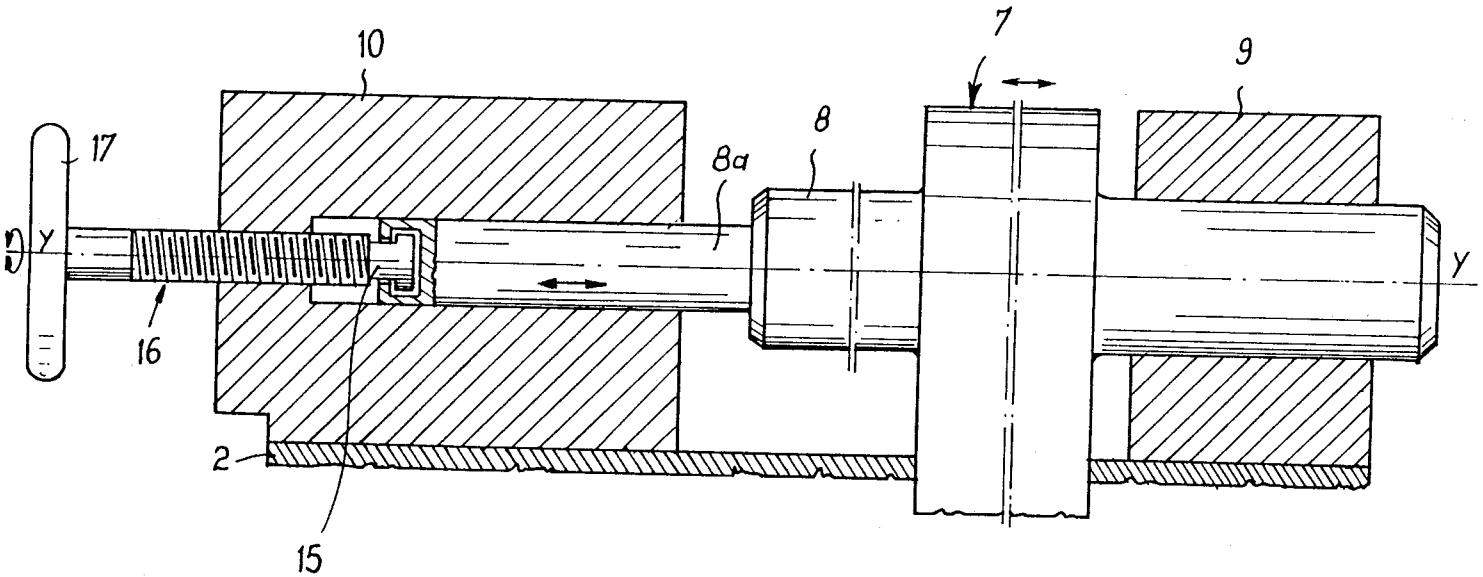
FIG. 5 is an elevation and enlarged partial section of the device for the transverse adjustment for the tilting support of the socket core.

The shaft 8 is also provided with means for adjusting its transverse position with respect to the casting machine, as illustrated in FIG. 5. In this example the adjustment means comprise a screw 16 coaxial with one end 8*a* of the shaft 8 engaged in the support bearing nut 10 integral with the machine CO. When the terminal part 15 of the screw 16 is introduced into the end 8*a* and thus connected to move in translation with the shaft 8, the screw 16 is screwed into the bearing nut 10 and is provided with a control hand-wheel 17. The rotation of the latter makes it possible to move the shaft 8 along its axis Y—Y and the tilting support 7 between the bearings 9 and 10.

The operation of the handling device which has been described is as follows:

(1) A pipe 41 (FIG. 2) having an end socket 42*a* has just been cast. The socket core 36 is still trapped between the socket 42*a* and the pan 43 supporting the core, itself locked on the chill-mould 1 in a manner known per se by centrifugal cotters (not shown). Whereas the machine and more specifically the mould is in its position furthest from the flow gate 5, the support 7 is in the upper waiting position with its ring 31 supporting the yoke CL directed towards the ground, as shown in FIG. 2, under the action of the control jack 29 whose rod is completely extended. The angle A between the axis Z—Z and the plane of the terminal face 11 of the casing 2 (FIG. 6) is approximately 110°.

(2) The pan 43 supporting the core 36 is extracted from the chill-mould 1, the pan having remained fixed in the socket end of the mould during the centrifugal casting of the pipe 41.

In order to do this, the support 7 is lowered by retracting the rod of the jack 29 until the yoke CL comes to bear against the pan 43 connected to the slowly rotating chill-mould by its centrifugal cotters. In a known manner the yoke CL is automatically locked to the pan 43 while the support 7 is held in its lowermost position, illustrated in FIGS. 1, 4 and 6, at an angle C of approximately 15° between the axis Z—Z and the terminal face 11.

The extraction of the pan 43 thus takes place by raising the support 7 towards its initial retracted position, i.e. until it forms an angle A of approximately 110° with the terminal face 11, the yoke CL remaining in engagement with the pan 43 after the removal of the centrifugal cotters when the rotation of the mould is stopped. During the extraction of the pan 43, the core 36 is separated automatically from the latter and disintegrates mechanically in a natural manner, a very low wrenching force being sufficient for the support 7 to cause such separation.

(3) The pipe 41 is removed from the mould (FIG. 2) by an axial extractor E known per se, with the support 7, the yoke CL and the pan 43 in the upper position.

(4) By actuating the jack 29 the support 7 is tilted downwardly about the shaft 8 to the position in which the axis Z—Z forms an angle B with the terminal face 11 (FIG. 6), the angle B being adjusted to suit the operator 35—approximately 50° for example.

At the same time that the support 7 tilts downwards, or at the end of this tilting movement, the ring 31 is pivoted by jack 38 to present it in the desired angular position (FIGS. 3 and 6) to the operator 35 to enable him to place a new core 36 on the pan 43 locked to the yoke CL.

The presentation of the pan 43 to the operator 35 in the manner of a suitably tilted stand depending on the morphology of the operator is advantageous and ergonomic in the sense that it substantially facilitates the positioning of relatively heavy cores 36. This suitable inclination of the pan 43 is enabled by the ring 31 being angularly offset by the arm 34.

This arrangement also has the advantage of allowing the operator to work in complete safety, by remaining at a distance from the dangerous areas of the casting machine. He may thus position successive cores 36 while remaining laterally at a distance from the machine, out of the trajectory of the extractor E on its travelling system and away from the radiation of heat.

(5) When a new core 36 has been fixed on the pan 43 in manner known per se and not illustrated, the yoke CL is restored to its initial position, i.e. pivoted through 90° about the axis Z—Z clockwise (arrow in FIG. 3) by the jack 38.

While maintaining this new position of the yoke CL, the support 7 is lowered about the shaft 8 and the core 36 is thus introduced into the socket of the chill-mould 1. This operation should preferably take place with the mould rotating at low speed about its axis X—X. Under the action of the jack 29 which continues its travel, the force exerted by the pan 43 against the support surfaces of the mould is intensified and forces the centrifugal cotters of the pan to engage in a receiving groove in the socket of the mould. This results in the disposition illustrated in FIGS. 4 and 6, in which the angle C is approximately 15°. The pan 43 is then automatically dissociated from the yoke CL, and the latter is again retracted by the support 7 to the position illustrated in FIGS. 2 and 6 in which it is separated by an angle A from the terminal face 11.

The entrance to the socket of the chill-mould is thus completely exposed, which facilitates the inspection of the casting inside the mould.

At the end of casting of a new pipe 41, the previously described process is repeated. As explained above, a significant advantage of the invention lies in the fact that the ring 31 may be presented laterally to the operator 35, inclined conveniently in the manner of a stand, which facilitates repeated positioning of relatively heavy socket cores 36 during a working shift. Correlatively, this arrangement substantially improves the safety of the operator, who may position successive cores while remaining at the side of the machine.

Naturally, the angle D of inclination of the ring 31 with respect to the axis Z—Z may vary substantially, in the same way as the inclination B of the support 7, depending on the morphology of the operator, in order to offer him the most appropriate ergonomic plane for positioning the socket cores.

What is claimed is:

1. An apparatus for handling and positioning a socket core (36) in association with a machine for centrifugally casting iron pipes (41) having end sockets (42*a*), comprising:

(a) an elongate machine casing (2), (b) an open-ended chill-mould (1) rotatably mounted in the casing, (c) a tilt support (7) mounted at one end of the casing for rotation about a first, horizontal axis (Y—Y) just above said one end, (d) a first jack (29) mounted between the casing and the support for rotating the support between a lowered position whereat the support substantially overlies said one end, an intermediate position whereat the support is angled outwardly from said one end, and a fully raised position whereat the support extends above said one end, (e) ring means (31, CL, 43) for gripping and supporting the socket core, and mounted to the tilt support for rotation about a second axis (Z—Z) perpendicular to the first axis, said ring means having a primary plane disposed at an acute angle (D) to the second axis, and (f) a second jack (38) mounted between the tilt support and the ring means for rotating the ring means between a position coaxial with the chill-mould when the tilt support is in its lowered position and a position whereat the plane of the ring means faces laterally of the chill-mould, (g) said acute angle opening downwardly when the tilt support is in its lowered position, whereby an operator may easily and safely mount a socket core on the ring means with the tilt support in its intermediate position and the ring means in its lateral position.

2. Apparatus according to claim 1, wherein the ring means is pivoted by a pair of spaced, diagonally opposite journals (32, 33), whereof a farthest journal (33) from the first axis is extended by an offset arm (34) perpendicular to the second axis (Z—Z) and to which the ring means is fixed at a point diametrically opposed to the point of attachment of a nearest journal (32) to the first axis, thereby establishing said acute angle of inclination of the ring means.

3. Apparatus according to claim 1 wherein the second jack is mounted on a bracket (40) integral with the tilt support and a piston rod (38*a*) thereof is pivoted in a clevis (37) fixed to an upper part of the ring means.

4. Apparatus according to claim 3, wherein the tilt support has a stirrup shape with two sides (22, 23) at the ends of which are bearings (24, 25) for receiving journals (32, 33) for pivoting the ring means about said second axis.

5. Apparatus according to claim 1, wherein the first axis is defined by a shaft (8) integral with the tilt support, and comprising means for adjusting the transverse position of the shaft with respect to the machine casing, said adjusting means comprising a screw (16) coaxial to one end (8*a*) of the shaft and engaged in a support bearing nut (10) integral with the machine casing and having a terminal part (15) fixed in said end of the shaft, said adjusting screw being provided with a control handwheel (17) whose rotation moves the shaft and the tilt support along the first axis.

6. Apparatus according to claim 4, wherein a bearing (25) closest to the tilt support axis forms a nut for receiving a screw (60) disposed on the second axis for adjusting the position of the ring means in translation along the second axis.

* * * * *